US010130921B2

(12) United States Patent
Hoefken

(10) Patent No.: US 10,130,921 B2
(45) Date of Patent: Nov. 20, 2018

(54) AGITATING MEMBER AND AGITATING DEVICE HAVING A PLURALITY OF SEGMENTS FOR CREATING A CURRENT IN A WASTEWATER TREATMENT BASIN

(71) Applicant: INVENT UMWELT—UND VERFAHRENSTECHNIK AG, Erlangen (DE)

(72) Inventor: Marcus Hoefken, Erlangen (DE)

(73) Assignee: INVENT UMWELT—UND VERFAHRENSTECHNIK AG, Erlangen (DE)

( * ) Notice: Subject to any disclaimer, the term of this patent is extended or adjusted under 35 U.S.C. 154(b) by 178 days.

(21) Appl. No.: 15/039,657

(22) PCT Filed: Oct. 15, 2014

(86) PCT No.: PCT/EP2014/072111

§ 371 (c)(1),
(2) Date: May 26, 2016

(87) PCT Pub. No.: WO2015/086198

PCT Pub. Date: Jun. 18, 2015

(65) Prior Publication Data

US 2017/0021313 A1 Jan. 26, 2017

(30) Foreign Application Priority Data

Dec. 11, 2013 (DE) ..... 10 2013 225 658

(51) Int. Cl.
*B01F 7/00* (2006.01)
*B01F 15/00* (2006.01)
*B21D 53/26* (2006.01)

(52) U.S. Cl.
CPC ..... *B01F 7/00541* (2013.01); *B01F 7/001* (2013.01); *B01F 7/0015* (2013.01);
(Continued)

(58) Field of Classification Search
CPC ..... B01F 7/0055; B01F 7/00541; B01F 15/00922; B01F 7/00033; B01F 7/0015;
(Continued)

(56) References Cited

U.S. PATENT DOCUMENTS 888,199 A * 5/1908 Stafford ..... B01F 7/001 366/67
1,687,660 A * 10/1928 Cummer ..... E01C 19/104 366/66

(Continued)

FOREIGN PATENT DOCUMENTS

DE 3519520 A1 * 12/1986 ..... B01F 3/04539
DE 3603466 A1 * 8/1987 ..... B01F 3/04539

(Continued)

OTHER PUBLICATIONS

PCT/ISA/210, "International Search Report for International Application No. PCT/EP2014/072111", dated Feb. 2015.

(Continued)

*Primary Examiner* — Charles Cooley
(74) *Attorney, Agent, or Firm* — Manabu Kanesaka

(57) ABSTRACT

A stirring body has a hyperboloid-like or truncated cone-like form and a central connector piece for connection to a stirring shaft. To simplify the production of the stirring body and to reduce the transport outlay, it is proposed for the stirring body to be formed from a plurality of segments which are interconnected along joining zones extending from a peripheral edge in the direction of the connector piece.

21 Claims, 6 Drawing Sheets

(52) U.S. Cl.
CPC ..... *B01F 7/00033* (2013.01); *B01F 7/0055* (2013.01); *B01F 15/00922* (2013.01); *B01F 2215/0052* (2013.01); *B21D 53/267* (2013.01)

(58) Field of Classification Search
CPC ..... B01F 2215/0052; B01F 7/00725; B01F 7/001; B21D 53/267
USPC ..... 416/231 R, 231 A; 366/331
See application file for complete search history.

(56) References Cited

U.S. PATENT DOCUMENTS 1,712,549 A * 5/1929 Castellano ..... E01C 19/185 222/238
1,741,013 A * 12/1929 Cummer ..... E01C 19/104 366/66
1,917,867 A * 7/1933 Barker ..... D06F 13/00 366/276
2,123,600 A * 7/1938 Galante ..... B01F 7/165 366/247
2,563,937 A * 8/1951 Keight ..... B01F 7/00158 366/181.4
2,636,720 A * 4/1953 Forrest ..... B01F 7/001 366/343
2,869,840 A * 1/1959 Schmidt ..... B01F 7/0025 366/196
4,304,494 A * 12/1981 Lutz ..... E01C 19/104 366/327.1
5,152,606 A * 10/1992 Borraccia ..... B01F 7/001 366/270
5,385,448 A * 1/1995 Merkt ..... B01F 7/001 366/330.5
5,524,982 A * 6/1996 Kruse ..... B01F 7/001 366/288
7,784,769 B2 * 8/2010 Hoefken ..... B01F 3/04773 210/150
D665,047 S * 8/2012 Hofken ..... B01F 7/00541 D23/207
8,434,744 B2 * 5/2013 Hoefken ..... B01F 3/04531 261/93
8,459,863 B2 * 6/2013 Hoefken ..... B01F 3/04539 366/331
8,651,732 B2 * 2/2014 Hoefken ..... B01F 3/04531 366/295
9,050,567 B2 * 6/2015 Hoefken ..... B01F 7/00541
D733,839 S * 7/2015 Hoefken ..... D23/200
D735,291 S * 7/2015 Hoefken ..... D23/200
10,058,832 B2 * 8/2018 Hoefken ..... B01F 7/00541
2005/0161838 A1 * 7/2005 Hofken ..... B01F 3/04531 261/93
2009/0127213 A1 * 5/2009 Hoefken ..... B01F 3/04773 210/800
2010/0182869 A1 * 7/2010 Hoefken ..... B01F 3/04531 366/343
2010/0196165 A1 * 8/2010 Hoefken ..... B01F 3/04531 416/223 R
2010/0201008 A1 * 8/2010 Hoefken ..... B01F 3/04531 261/93
2011/0003646 A1 * 1/2011 Hoefken ..... B01F 3/04539 464/178
2012/0307587 A1 * 12/2012 Hoefken ..... B01F 7/00541 366/331
2016/0339401 A1 * 11/2016 Hoefken ..... B01F 7/0055
2017/0001156 A1 * 1/2017 Hoefken ..... B01F 7/00541
2017/0021313 A1 * 1/2017 Hoefken ..... B01F 7/00541
2017/0065945 A1 * 3/2017 Hoefken ..... B01F 7/00541

FOREIGN PATENT DOCUMENTS

DE 9106639 U1 * 9/1991 ..... B01F 3/04531
DE 9106639 U1 9/1991
DE 4218027 A1 * 12/1992 ..... B01F 3/04531
DE 29803497 U1 6/1999
WO 2006/108538 A1 10/2006

OTHER PUBLICATIONS

PCT/ISA/237, "Written Opinion of the International Searching Authority for International Application No. PCT/EP2014/072111," dated Feb. 2015.
Hoefken, M. et al., "Ruehr- und Begasungssysteme fuer die effektive Abwasserbehandlung," p. 91-95, vol. 2, Brauindustrie, Retrieved from the Internet: URL: http://fzarchiv.sachon.de/index.php?pdf=Fachzeitschriften/Getraenke-Fachzeitschriften/Brauindustrie/1998/02_98/Bi_02-98_Ruehr-_und_Begasungssysteme_fuer_Abwasserbehandlung.pdf [Retrieved on Sep. 17, 2008].
PCT/ISA/237, "Written Opinion of the International Searching Authority for International Application No. PCT/EP2014/072111," dated Feb. 9, 2015.

* cited by examiner

AGITATING MEMBER AND AGITATING DEVICE HAVING A PLURALITY OF SEGMENTS FOR CREATING A CURRENT IN A WASTEWATER TREATMENT BASIN

RELATED APPLICATIONS

The present application is National Phase of International Application No. PCT/EP2014/072111 filed Oct. 15, 2014, and claims priority from German Application No. 10 2013 225 658.2, filed Dec. 11, 2013, the disclosure of which is hereby incorporated by reference herein in its entirety.

BACKGROUND OF THE INVENTION

Field of the Invention

The invention relates to a stirring body and a stirring device for generating a current in a wastewater treatment tank.

Description of the Related Art

A stirring device is known by way of example from DE 91 06 639.5 U1. In the known stirring device a hyperboloid-like stirring body in practice usually has a diameter from 1.5 to 3 m. A stirring shaft is mounted on a connector piece protruding in the middle or centrally.

Stirring bodies of this type are produced from glass fibre-reinforced plastic. For this purpose, a plurality of layers of a fabric produced from glass fibres are laminated on top of each other with use of a suitable mould in a manual process. The costs for the production of a stirring body of this type are high. In addition, the stirring body is bulky and requires a large transport volume.

SUMMARY OF THE INVENTION

The object of the invention is to overcome the disadvantages according to the prior art. In particular, a stirring body and a stirring device which can be produced as easily and economically as possible will be specified. In accordance with a further objective of the invention, the stirring body and the stirring device will be transportable with reduced outlay.

These objects are achieved by some aspects of the invention. Expedient embodiments of the invention will emerge from those aspects of the invention.

In accordance with the invention provision is made for the stirring body to be formed from a plurality of segments which are interconnected along joining zones extending from a peripheral edge in the direction of the connector piece.—The production of segments requires significantly less effort. The segments can be produced with use of a much smaller mould. Because the stirring body is formed from segments, it can be transported in a disassembled state to the place of use and assembled once there. This saves transport costs. It has surprisingly been found that the stirring body according to the invention has excellent mechanical stability, which is comparable to the mechanical stability of conventional stirring bodies fabricated from one piece.

In accordance with an advantageous embodiment of the invention the segments each have a first joining portion with a first joining profile and a second joining portion with a second joining profile corresponding to the first joining profile. The first joining profile is preferably formed in the manner of a step. A height of the step advantageously corresponds to a thickness of the segment in the region of the second joining portion. In this case, the second joining profile can expediently be formed flat.

In accordance with a further embodiment of the invention an aperture is provided in the segment in the region of the first joining portion. The aperture extends advantageously in a radially inner half of the segment along the first joining portion. The term "radially inner half of the segment" is understood to mean the half comprising a connector piece portion of the connector piece. A portion of the second joining portion opposite the aperture in the peripheral direction can have a recess at the edge. The recess at the edge corresponds in terms of its radial extension to the radial extension of the aperture, such that, in the assembled state, the recess complements the aperture in the adjacent segment.

In accordance with a particularly advantageous embodiment a plurality, preferably all, of the segments each has a transport rib extending from the peripheral edge portion of said segment to the connector piece portion of said segment. A height of the transport rib advantageously increases from the peripheral edge portion to the aperture and then decreases again in the direction of the connector piece portion. A ratio between a minimum height of the transport rib in the region of the peripheral edge portion to a maximum height lies for example in the range from 1:5 to 1:100, preferably 1:5 to 1:20.

The transport rib extends advantageously from the first joining portion. It is expediently produced in integral design with the first joining portion and has approximately the thickness of the segment. The transport rib formed in the manner of a web has advantageously a substantially rectangular cross section. It can delimit the aperture in part and in the region of the aperture can have a web, which extends through the aperture and which in the assembled state engages with the recess at the edge in the second joining portion of an adjacent segment. Adjacent segments can therefore be easily joined in an accurately fitting manner.

Of course, mating means corresponding to one another and embodied in a different way can be provided on the first and on the second joining portion. Here, said mating means may be conical pins and corresponding recesses, webs and corresponding slot-like recesses, or the like.

Fastening means corresponding to one another can also be provided on the first and on the second joining profile. These fastening means can be, for example, threaded bushings and apertures for passing through screws or the like.

The connector piece can have further apertures for passing through fastening means for fastening the stirring body to a stirring shaft. By way of example, the fastening means can be screws, rivets or the like.

In accordance with a particularly advantageous embodiment of the invention the segments are produced from cast plastic or metal. The plastic can be formed from two components. In particular, polyolefins, in particular PP, PS, ABS, PA, POM, EVAC, GFK, NCF, SAN, UP, VPE, Tellene, HDPE or other plastics which are suitable for processing by means of casting or injection moulding can be used as plastic. Within the scope of injection moulding, injection moulding of thermoplastics, injection moulding of thermoset materials, multi-component injection moulding methods, in particular in-mould methods, or powder injection moulding methods can be considered. In the case of casting methods, vacuum casting is considered in particular. Short fibres can also be added to the plastic in order to increase rigidity.

It is also possible to produce the segments, for example in pressure diecasting methods, from metal, in particular from an aluminium alloy. Possible alloys include AlSi9Cu3(Fe), AlSi12Cu1(Fe), AlSi12(Fe) and AlSi10MgCu.

In accordance with a further embodiment a connection element for connection to the stirring shaft can be mounted on the connector piece. A connection element of this type can be formed for example in the manner of an adapter. The stirring body can thus be configured for connection to a large number of shaft connector fittings commonly found on the market.

The first and the second joining portion are advantageously curved in a radial direction from the peripheral edge in the direction of the connector piece. In other words, the first and the second joining portion extend in a slanting manner in the region of the peripheral edge and then bend in the direction towards the connector piece in a radial direction. Here, the transport rib advantageously extends parallel to the first joining zone. The curved profile of the transport rib enables a particularly efficient generation of a current in wastewater.

In accordance with a further embodiment the segments are adhesively bonded and/or screwed to one another. In particular, a combined screwed and bonded connection leads to a particularly stable stirring body.

Each segment can have at least one transport rib. Although it is expedient for each of the segments to have just one transport rib and to therefore be relatively slim, it is also possible for segments to have a plurality of transport ribs.

In any case, it has proven to be particularly advantageous if the segments are structurally identical. In this case merely a single mould must be conserved for the production of a stirring body.

In accordance with a further provision of the invention, a stirring device for generating a current in a wastewater treatment tank is proposed, in which device a stirring body according to the invention is mounted on a stirring shaft extending from a drive arrangement. A stirring device of this type can be easily produced and transported with low outlay.

In accordance with an advantageous embodiment the stirring shaft has axially extending ribs, which engage with corresponding grooves on the connector piece. The axial grooves provided on the inner periphery of the connector piece are formed expediently by the first joining profiles of the adjacently arranged connector piece portions of the segments.

Exemplary embodiments of the invention will be explained in greater detail hereinafter on the basis of the drawings, in which:

DESCRIPTION OF THE PREFERRED EMBODIMENTS

In the figures, reference sign 1 in general denotes a stirring body, which has an upper side O, a peripheral edge UR, and an underside U. A connector piece for attachment of a stirring shaft is denoted in general by reference sign 2.

The stirring body 1 in the present exemplary embodiment has a hyperboloid-like form. It is formed in the present exemplary embodiment from eight segments S1 to S8, which are interconnected along joining zones F1 to F8 extending from the peripheral edge UR in the direction of the connector piece 2.

Figure 2:
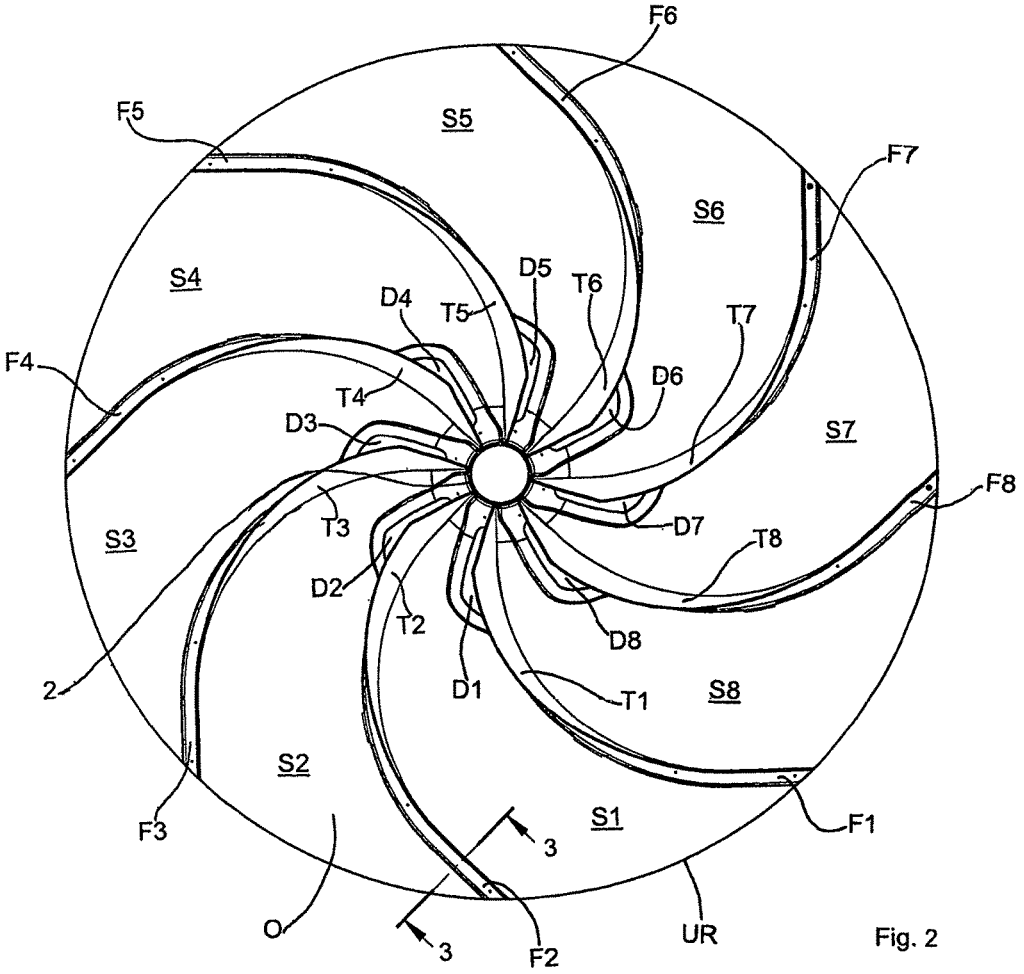
FIG. 2 shows a plan view of the stirring body according to FIG. 1.
Figure 3:
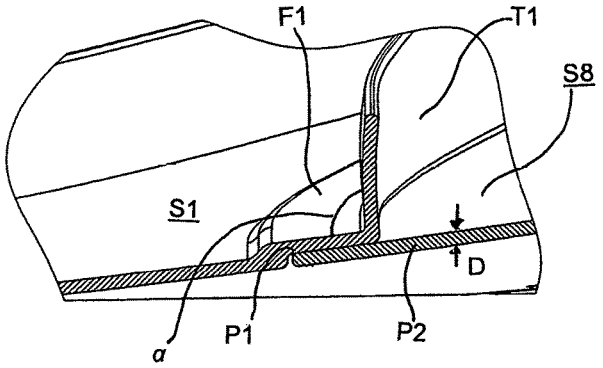
FIG. 3 shows a sectional view according to the section line 3-3 in FIG. 2.

The first joining zone F1 is shown in greater detail in FIGS. 2 and 3. Each of the advantageously structurally identical segments S1 to S8 has, on one of its long edges, a first joining portion Fa1 with a first joining profile P1 and, on its other long edge, a second joining portion Fa2 with a second joining profile P2 (see also FIGS. 5 and 6). In the present exemplary embodiment the first joining profile P1 is formed in the manner of a step, from which a transport rib T1 extends at an angle $\alpha$ in the range from 60 to 90°. The second joining profile P2, which is provided on the second long edge, opposite the first long edge in the peripheral direction, corresponds in the present exemplary embodiment in cross section to a plate (see FIG. 3). The second joining profile P2 corresponds with the first joining profile P1 in such a way that, in the assembled state, the contours of all undersides of the segments S1 to S8 complement one another to form a flat overall contour forming the underside U of the stirring body 1. For this purpose, the second joining profile P2 has a thickness D which corresponds to a height of the step of the first joining profile P1.

Figure 4:
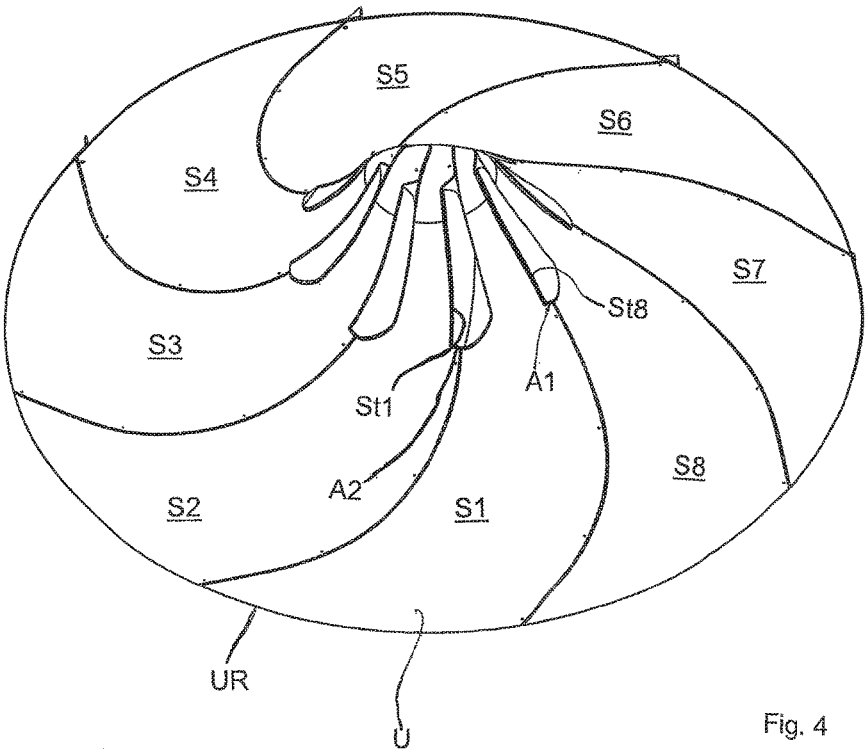
FIG. 4 shows a perspective view from below of the stirring body according to FIG. 1.
Figure 5:
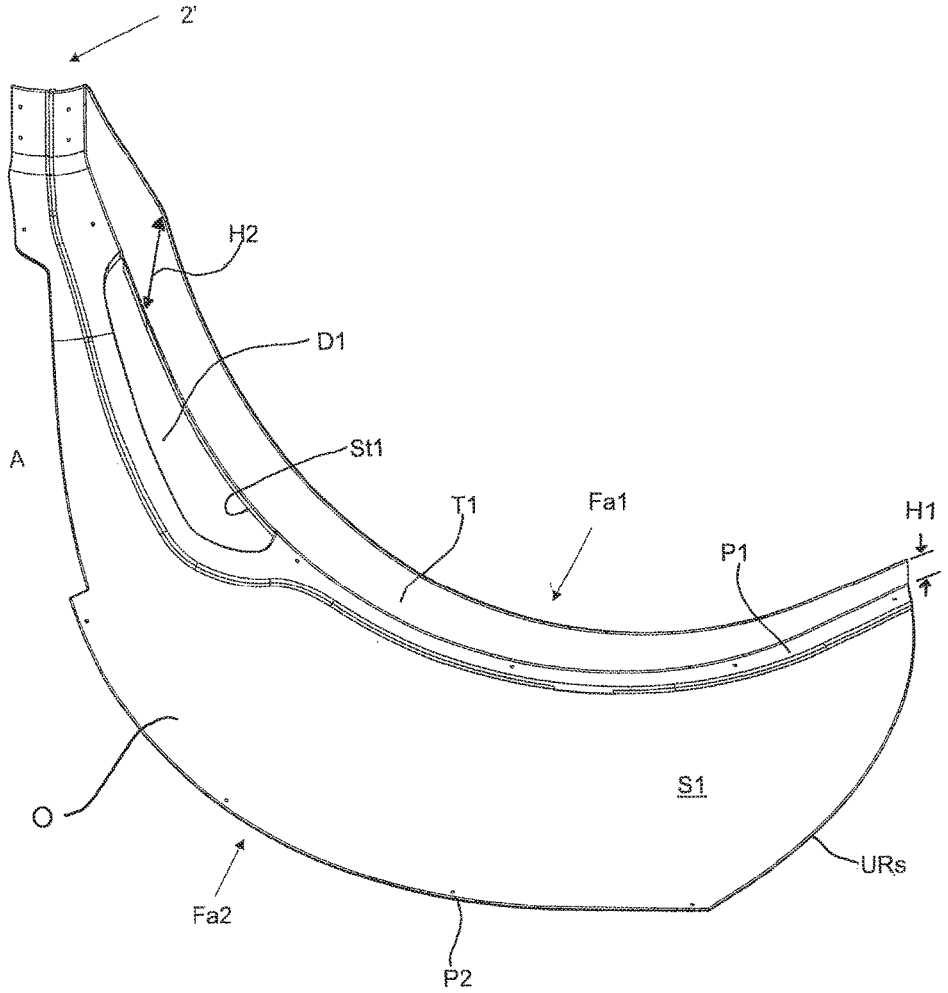
FIG. 5 shows a perspective view of a segment.
Figure 6:
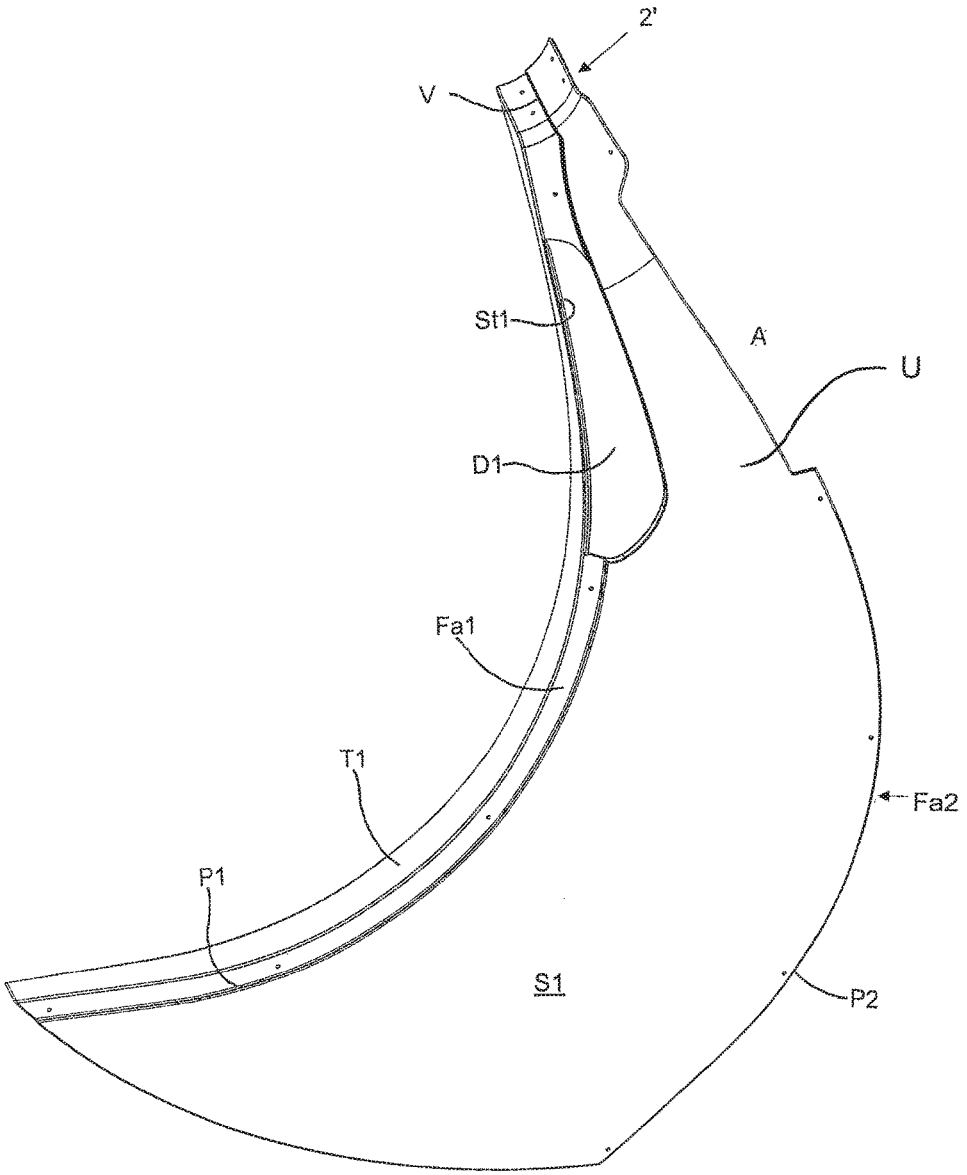
FIG. 6 shows a perspective view from below of the segment according to FIG. 5.

FIGS. 5 and 6 show, by way of example, perspective views of the first segment S1. The first segment S1 has a first aperture D1, which extends in a radially inner half of the first segment S1 along the first joining portion Fa1. The first transport rib T1 delimits the first aperture D1 in part. A portion of the second joining portion Fa2 opposite the first aperture D1 in the peripheral direction has a recess A at the edge. The recess A at the edge is formed such that an eighth web St8 (see FIG. 4) extending from an eighth transport rib T8 of the eighth segment S8 is received in said recess in an interlocking manner in the assembled state.

The first transport rib T1 has a minimum height H1 in the region of the peripheral edge portion URs and has a maximum height H2 in the region of the first aperture D1 (see FIG. 5). A ratio H1/H2 lies in the range 1/5 to 1/100, preferably in the range from 1/5 to 1/20.

Figure 1:
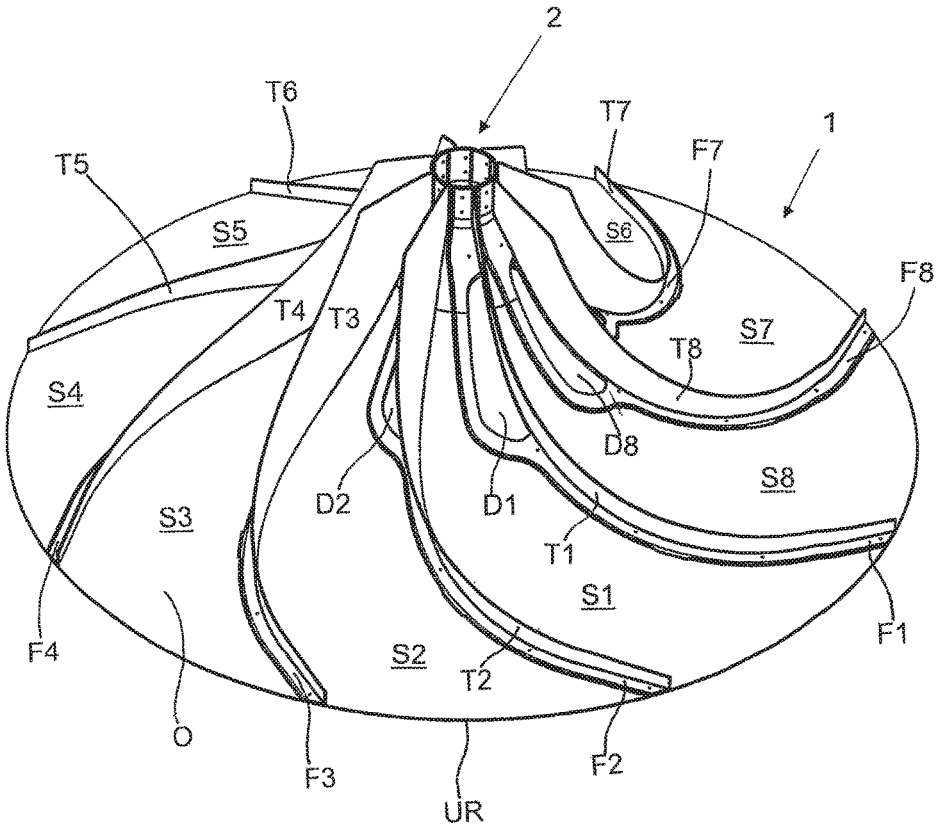
FIG. 1 shows a perspective view of a stirring body.

As can be seen in particular from FIG. 1 to 3, the angle $\alpha$ between the first transport rib T1 and the upper side O decreases from the peripheral edge UR to the connector piece 2, such that the first transport rib T1 is inclined relative to the first aperture D1, in particular in the region of the first aperture D1. The maximum height H2 decreases again from the first aperture D1 in the direction of a connector piece portion 2'.

As is clear in particular from FIG. 5, the joining portions Fa1, Fa2 are curved. The joining portions Fa1, Fa2 and the first transport rib T1 extending from the first joining portion Fa1 extend approximately radially in a radially inner portion of the stirring body 1 and then bend in a tangential direction, such that, in the region of a peripheral edge portion URs, they extend in a slanting manner relative to said peripheral edge portion.

The first aperture D1 is delimited, as considered from the upper side O, by the convexly curved side of the first transport rib T1. The same is true for the arrangement of the further apertures D2 to D8 with respect to the corresponding further transport ribs T2 to T8.

As is shown in particular in FIG. 6, the connector piece portion 2' formed substantially in the manner of a portion of a cylinder jacket has a step-like offset V corresponding to the step-like design of the first joining profile P1. In other words, the first joining profile P1 extends into the connector piece portion 2', apart from the interruption formed by the first aperture D1.

Figure 7:
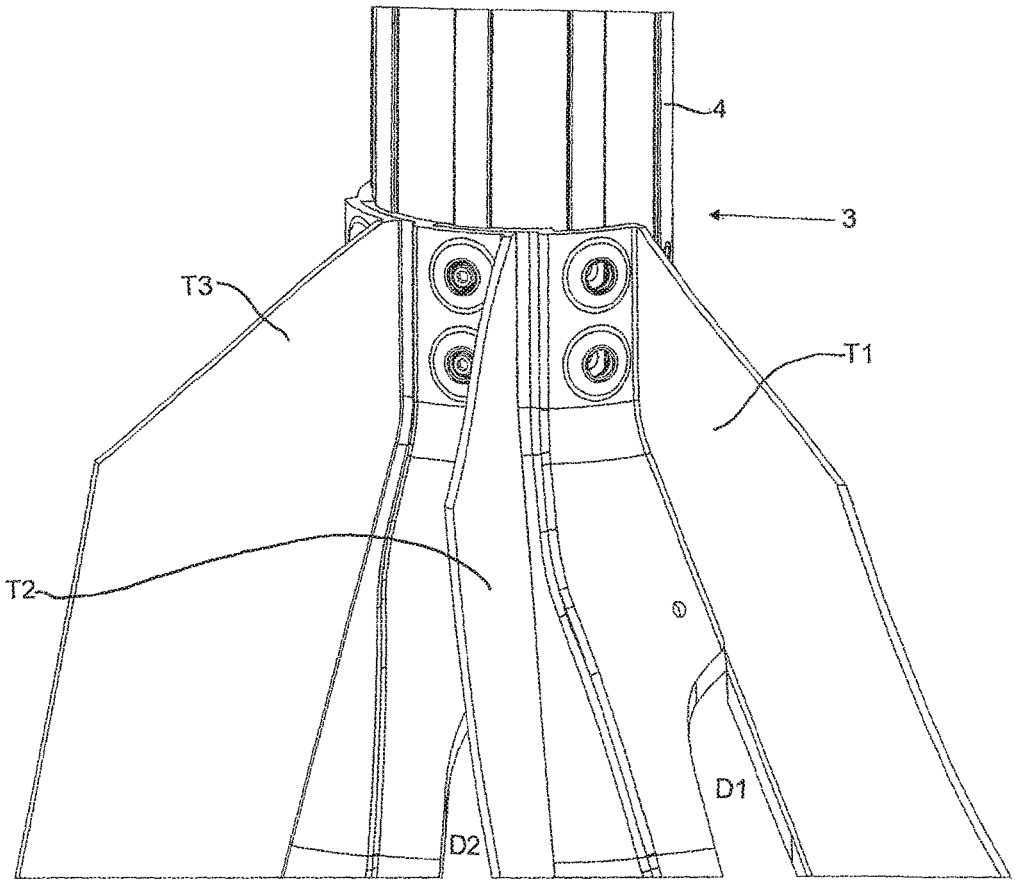
FIG. 7 shows a perspective partial view of a connector piece.
Figure 8:
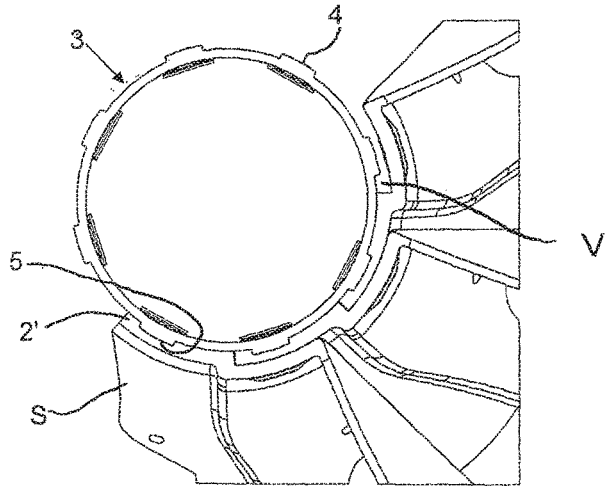
FIG. 8 shows a sectional view through the connector piece shown in part in FIG. 7.

FIGS. 7 and 8 show an embodiment of the connector piece 2 in combination with a stirring shaft 3. The stirring shaft 3 here has axially extending ribs 4. The connector piece portions 2' of the segments are formed here such that grooves 5 formed in a manner corresponding to the ribs 4 are provided in said connector piece portions, such that the ribs 4 engage in an interlocking manner with the grooves 5. A connection between the stirring body 1 and the stirring shaft 3 in particular such that conjoint rotation therebetween is provided can thus be produced.

Although the stirring body 1 has a hyperboloid-like form in the figures, it may also be that the stirring body 1 is formed for example in the manner of a truncated cone.

The segments S1 to S8 shown in the figures are expediently structurally identical. They can be produced easily from plastic by means of casting. In particular, the following plastics are suitable for production of the segments S1 to S8: polyolefins, in particular PP, PS, ABS, PA, POM, EVAC, GFK, NCF, SAN, UP, VPE, Tellene, HDPE and the like.

The presently described stirring body 1 is constructed from eight structurally identical segments S1 to S8. It is of course also possible to produce a similar stirring body 1 from a smaller or larger number of structurally identical segments.

In the shown exemplary embodiment each of the segments S1 to S8 has a transport rib T1 to T8, each of said transport ribs being arranged along one long edge. Of course, it is also possible to provide the transport ribs T1 to T8 for example centrally in the segment S1. It is also conceivable to combine segments S1 to S8 without transport ribs T1 to T8 with segments S1 to S8 that have transport ribs T1 to T8.

The segments S1 to S8 shown in the present exemplary embodiment each have an aperture D1 to D8. Of course, it is also possible to omit the apertures D1 to D8 or to combine segments S1 to S8 having apertures D1 to D8 with further segments S1 to S8 that have no apertures D1 to D8.

The segments S1 to S8 can be interconnected preferably by means of screw connections not shown here in greater detail. By way of example, threaded bushings can be provided for this purpose in the region of the second joining profile P2. It is also possible to adhesively bond the segments S1 to S8 to one another in addition to the aforementioned screwed connections. In order to facilitate the assembly of the stirring body 1, a template can be provided for example, onto which the segments S1 to S8 are placed and interconnected in succession.

The proposed stirring body 1 can be produced and transported with reduced outlay. It nevertheless has outstanding strength.

LIST OF REFERENCE SIGNS 1 stirring body
2 connector piece
2' connector piece portion
3 stirring shaft
4 rib
5 groove
A recess
D thickness
D1 to D8 aperture
F1 to F8 joining zone
Fa1 first joining portion
Fa2 second joining portion
H1 minimum height
H2 maximum height
O upper side
P1 first joining profile
P2 second joining profile
S1 to S8 segment
St1 first web
T1 to T8 transport rib
U underside
UR peripheral edge
URs peripheral edge portion
V offset
α angle

The invention claimed is:

1. A stirring body having a hyperboloid or truncated form, comprising:
   - a central connector piece for connecting to a stirring shaft; and
   - a plurality of segments,
   - wherein the stirring body has an upper side, a peripheral edge, and an underside,
   - each of the plurality of segments has a first joining portion with a first joining profile on a longitudinal edge thereof and a second joining portion with a second joining profile on another longitudinal edge thereof,
   - the first joining profile and the second joining profile form in an interconnected state joining zones extending from the peripheral edge to the connector piece,
   - a contour of the second joining profile corresponds with a contour of the first joining profile in such a way that an underside of one of the plurality of segments connects with another underside of another one of the plurality of segments to form an overall flat contour forming the underside of the stirring body when the plurality of segments is assembled.

2. The stirring body according to claim 1, wherein the first joining profile is formed in a manner of a step.

3. The stirring body according to claim 2, wherein a height of the step corresponds to a thickness of each of the plurality of segments in a region of the second joining portion.

4. The stirring body according to claim 1, wherein an aperture is provided in each of the plurality of segments in a region of the first joining portion.

5. The stirring body according to claim 4, wherein the aperture extends in a radially inner half of each of the plurality of segments along the first joining portion.

6. The stirring body according to claim 4, wherein a portion of the second joining portion located opposite the aperture in a peripheral direction has a recess at an edge.

7. The stirring body according to claim 4, wherein the plurality of segments each have a transport rib extending from a peripheral edge portion of each of said plurality of segments to a portion of the connector piece of each of said plurality of segments.

8. The stirring body according to claim 7, wherein a height of the transport rib increases from the peripheral edge portion to the aperture and decreases in a direction of the portion of the connector piece.

9. The stirring body according to claim 7, wherein the transport rib extends from the first joining portion.

10. The stirring body according to claim 7, wherein the transport rib delimits the aperture in part.

11. The stirring body according to claim 1, wherein the first joining portion and the second joining portion are curved in a radial direction from the peripheral edge in a direction of the connector piece.

12. The stirring body according to claim 1, wherein mating parts corresponding to one another are provided on the first joining portion and on the second joining portion.

13. The stirring body according to claim 1, wherein fastening parts corresponding to one another are provided on the first joining portion and on the second joining portion.

14. The stirring body according to claim 1, wherein the connector piece has a plurality of holes for guiding fastening parts therethrough for fastening the stirring body to the stirring shaft.

15. The stirring body according to claim 1, wherein the plurality of segments is produced from a cast plastic or from metal.

16. The stirring body according to claim 15, wherein the plastic is selected from the group consisting of polyolefins, PP, PS, PA, POM, EVAC, GFK, NCF, SAN, UP, VPE, Tellene, ABS, and HDPE.

17. The stirring body according to claim 1, wherein a connection element for connection to the stirring shaft is mounted on the connector piece.

18. The stirring body according to claim 1, wherein each of the plurality of segments is screwed and/or adhesively bonded to one another.

19. The stirring body according to claim 1, wherein each of the plurality of segments is structurally identical.

20. A stirring device, comprising:

the stirring body according to claim 1 mounted on the stirring shaft extending from a drive arrangement, wherein the stirring device generates a current in a wastewater treatment tank.

21. The stirring device according to claim 20, wherein the stirring shaft has axially extending ribs, which engage with corresponding grooves on the connector piece.

* * * * *